US006666800B2

(12) United States Patent
Krull

(10) Patent No.: US 6,666,800 B2
(45) **Date of Patent: *Dec. 23, 2003**

(54) METHODS AND APPARATUS FOR ADJUSTING RESISTANCE TO EXERCISE

(76) Inventor: Mark A. Krull, P.O. Box 57, Greencastle, IN (US) 46135

( * ) Notice: Subject to any disclaimer, the term of this patent is extended or adjusted under 35 U.S.C. 154(b) by 157 days.

This patent is subject to a terminal disclaimer.

(21) Appl. No.: 09/796,234

(22) Filed: Feb. 28, 2001

(65) Prior Publication Data

US 2002/0049123 A1 Apr. 25, 2002

Related U.S. Application Data

(63) Continuation-in-part of application No. 09/695,668, filed on Oct. 24, 2000.
(60) Provisional application No. 60/162,291, filed on Oct. 28, 1999.

(51) Int. Cl.[7] ..... A63B 21/06; A63B 21/062

(52) U.S. Cl. ..... 482/94; 482/98; 482/99
(58) Field of Search ..... 482/94, 98, 99, 482/100, 101, 102, 103, 138

(56) References Cited

U.S. PATENT DOCUMENTS

| | | | | |
|---|---|---|---|---|
| 5,776,040 A | * | 7/1998 | Webb et al. | 482/98 |
| 6,117,049 A | * | 9/2000 | Lowe | 482/4 |
| 6,193,635 B1 | * | 2/2001 | Webber et al. | 482/138 |
| 6,277,058 B1 | * | 8/2001 | Sparks | 482/100 |
| 6,436,013 B1 | * | 8/2002 | Krull | 482/94 |

* cited by examiner

*Primary Examiner*—Nicholas D. Lucchesi
*Assistant Examiner*—Fenn C Mathew

(57) ABSTRACT

A weight stack exercise machine includes a stack of primary weights movably mounted on a frame, and at least one counter-weight which is selectively alternated between an inactive state, supported by the frame, and an active state, exerting a counter-weight force relative to the top plate in the stack of primary weights.

24 Claims, 5 Drawing Sheets

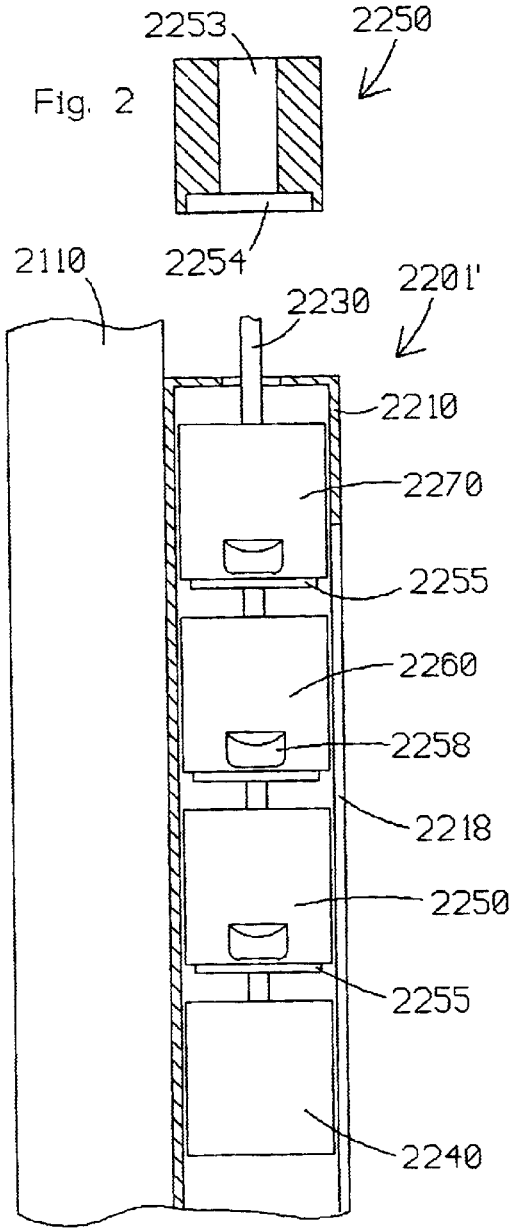
Fig. 2
Fig. 3
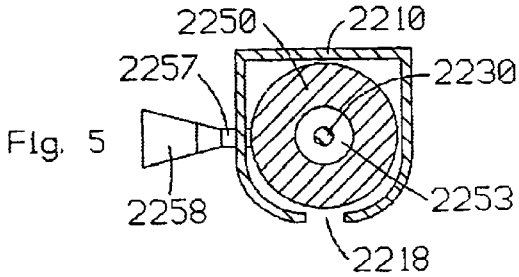
Fig. 5
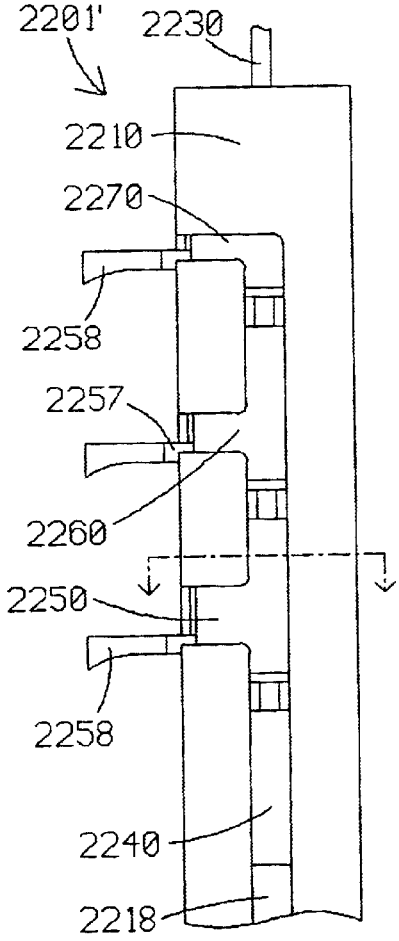
Fig. 4

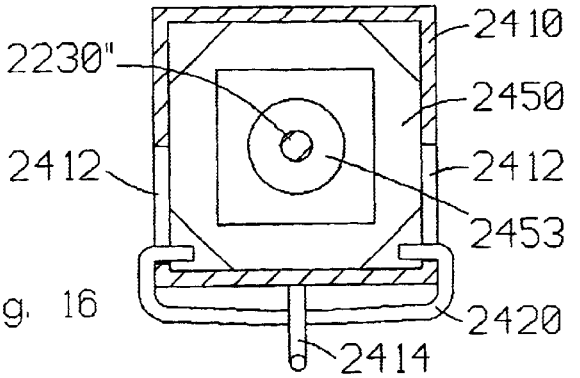
Fig. 16
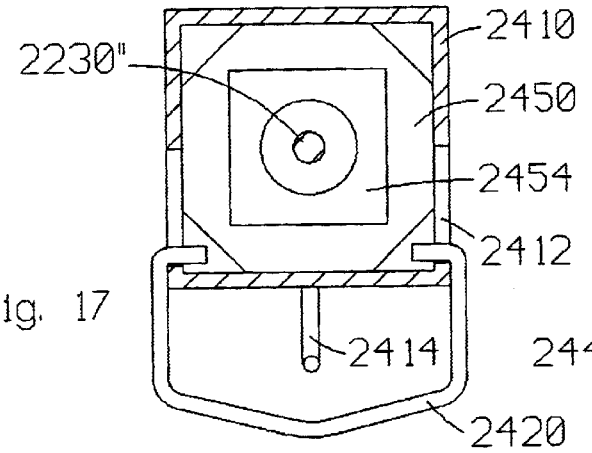
Fig. 17
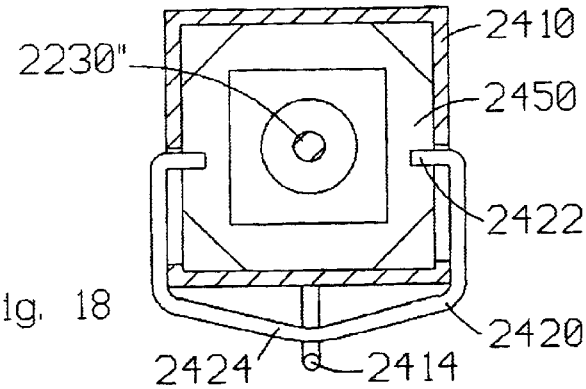
Fig. 18
Fig. 15
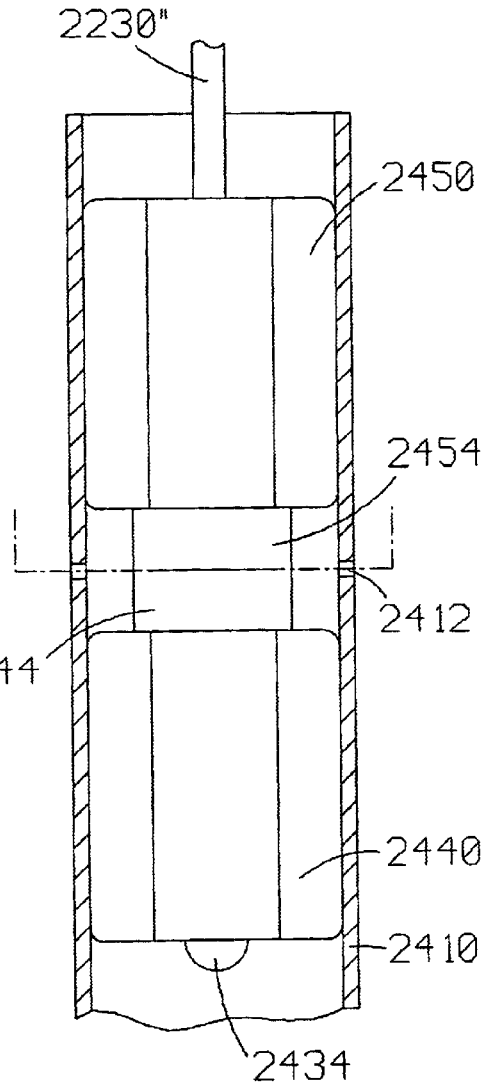

METHODS AND APPARATUS FOR ADJUSTING RESISTANCE TO EXERCISE

CROSS-REFERENCE TO RELATED APPLICATIONS

This is a continuation-in-part of U.S. patent application Ser. No. 09/695,668, filed on Oct. 24, 2000, which in turn, discloses subject matter entitled to the filing date of U.S. Provisional No. 60/162,291, filed on Oct. 28, 1999.

FIELD OF THE INVENTION

The present invention relates to exercise equipment and more particularly, to exercise equipment that uses a variable number of weights to resist exercise motion.

BACKGROUND OF THE INVENTION

Exercise weight stacks are known in the art. Generally speaking, weight plates are arranged in a stack and movably mounted on at least one guide rod. A selector rod is connected to a desired number of weight plates by a pin (or other suitable means known in the art). The selector rod and any selected weight plates are connected to a force receiving member by a cable (or other suitable means known in the art) which pulls the weight plates upward in response to exercise movement.

Although exercise weight stacks are prevalent in the exercise industry, they nonetheless suffer from certain shortcomings. For example, in order to provide a large amount of weight at a reasonable cost and within a reasonable amount of space, equipment manufacturers use a small number of relatively heavy weight plates. As a result, the amount of weight being lifted cannot be adjusted in small increments. On the other hand, a relatively large number of lighter weight plates may be used in order to provide smaller increments in weight adjustment, but the resulting equipment would be relatively more expensive and/or bulky.

Attempts have been made to address the issue of incremental weight adjustments. One such approach involves the provision of a loose half-weight (weighing one-half as much as a weight plate in the stack) that is selectively movable onto the top plate at the discretion of a user. This particular arrangement is not well suited for institutional environments because the half-weight may be lost, stolen, or misused. Another prior art approach involves the provision of a half-weight or other fractional weight(s) that is/are selectively movable from a peg on the frame onto an aligned peg on the top plate of the stack. This approach not only fails to overcome the possibility of losing the half-weight, but it creates a balance problem during movement of the selected weights, and it also increases the potential for injury due to the proximity of the two pegs and their movement relative to one another. Yet another prior art approach involves the provision of a second, smaller weight stack comprising weight plates which weigh a fraction of the weight plates in the primary stack. Unfortunately, this approach adds significantly to both the cost and the size of the equipment.

Yet another prior art weight stack machine with supplemental or secondary weights is disclosed in French Patent No. 2,613,237 to Louvet. The Louvet machine includes a stack of primary weight plates movable along a guide rod in response to exercise movement, and a stack of secondary weights movable along the guide rod and selectively stored above the stack of primary weight plates. The secondary weights are supported by gates which are rotatably mounted on rigid frame members, and which have pegs that rotate into engagement with holes in the frame members. Each of the nine secondary weights has a mass equal to one-tenth the mass of one of the primary weight plates. One disadvantage of the Louvet machine is that nothing prevents a user from releasing a secondary weight without grasping the weight. As a result, the secondary weight may be free to drop downward onto the top plate in the primary weight stack, thereby increasing the likelihood of personal injury and/or damage to the machine. Also, each of the secondary weights is not separately supported by a respective gate. As a result, the entire stack of secondary weights may be released at one time, with or without a user holding onto any of the weights.

Still other prior art approaches are disclosed in Soviet Union Patent No. 1347-948-A and Japan Patent No. 10-118222. Each of these patents discloses first and second secondary weights which are movably mounted on discrete guide rods located outside the planform of the primary weight stack. The secondary weights in the Soviet patent are pivotally mounted on respective, dedicated guide rods for movement into respective positions overlying the top plate in the primary weight stack. The secondary weights in the Japan patent are releasably secured to the top plate by a separate selector pin. A shortcoming common to both of these approaches is the need for separate guide rods for the secondary weights, and/or the imposition of non-aligned weight on the primary weight stack. In other words, despite all of the efforts discussed above, room for better solutions and/or improvements still exists.

A prior art weight stack machine having both a primary weight stack and counter-weights is disclosed in U.S. Pat. No. 4,765,611 to MacMillan (cited during prosecution of a parent application). The MacMillan patent discloses two different embodiments that use counter-weights to impose a first magnitude of gravitational force during the power stroke portion of an exercise, and that release the counter-weights to impose a relatively greater, second level of gravitational force during the return stroke portion of the exercise. One MacMillan machine places a desired number of primary weights on a first end of a lever, and intermittently links a desired number of counter-weights to an opposite, second end of the lever. The other MacMillan machine places a desired number of primary weights on a first end of a cable, and intermittently links a desired number of counter-weights to an opposite second end of the cable. These approaches are not specifically directed toward the concept of fractional adjustments to resistance, and even if they were, room for improvement would remain.

SUMMARY OF THE INVENTION

Generally speaking, the present invention relates to exercise methods and apparatus involving a stack of primary weight plates movably mounted relative to a frame, and at least one secondary weight which is selectively activated to incrementally reduce the weight of the selected primary weight plates. A connector is selectively interconnected between the secondary weight and the top plate in the primary weight stack. More specifically, the connector includes a first portion which is connected to the top plate, a second portion which selectively supports the secondary weight, and a third portion which is intermediate the first portion and the second portion, and which is connected to the machine frame. As a result of this arrangement, the secondary weight acts as a counter-weight vis-a-vis the top plate when the former is supported by the second portion of the connector. The connector is preferably a cable, and the third, intermediate portion of the connector is preferably routed about pulleys on the frame. Moreover, the frame is preferably provided with structure to guide the secondary weight in a direction opposite that of the top plate.

On some embodiments of the present invention, the secondary weight is selectively movable between an active position, supported by the connector, and an inactive position, supported by the frame. On other embodiments of the present invention, a fastener or latch is selectively movable between an active position, interconnected between the frame and the secondary weight, and an inactive position, connected at most to only of the frame and the secondary weight. In any event, the secondary weight(s) may be configured for engagement and disengagement in various ways, including rotational movement, translational movement, or a combination thereof. Many of the features, variations, and advantages of the present invention will become apparent from the more detailed description that follows.

BRIEF DESCRIPTION OF THE FIGURES OF THE DRAWING

FIG. 2 is a sectioned side view of a secondary weight on the exercise apparatus of FIG. 1;

FIG. 3 is a partially sectioned and fragmented, front view of a secondary weight assembly on the exercise apparatus of FIG. 1, with optional knobs shown on the secondary weights;

FIG. 4 is a partially fragmented, side view of the secondary weight assembly of FIG. 3;

FIG. 5 is a partially sectioned top view of the secondary weight assembly of FIG. 3;

FIG. 15 is a partially sectioned front view of yet another secondary weight assembly constructed according to the principles of the present invention;

FIG. 16 is a partially sectioned bottom view of the secondary weight assembly of FIG. 15 (showing the assembly with its selector pin in an inactive position);

FIG. 17 is a partially sectioned bottom view of the secondary weight assembly of FIG. 15 (showing the assembly with its selector pin in an intermediate position); and FIG. 18 is a partially sectioned bottom view of the secondary weight assembly of FIG. 15 (showing the assembly with its selector pin in an active position).

DETAILED DESCRIPTION OF A PREFERRED EMBODIMENT

The present invention provides methods and apparatus related to incremental adjustment of weight stack resistance. In a preferred application, an otherwise conventional weight stack machine is provided with at least one counter-weight that is selectively maneuverable between an inactive position, supported by the frame, and an active position, acting upon the top plate in the primary weight stack.

Figure 1:
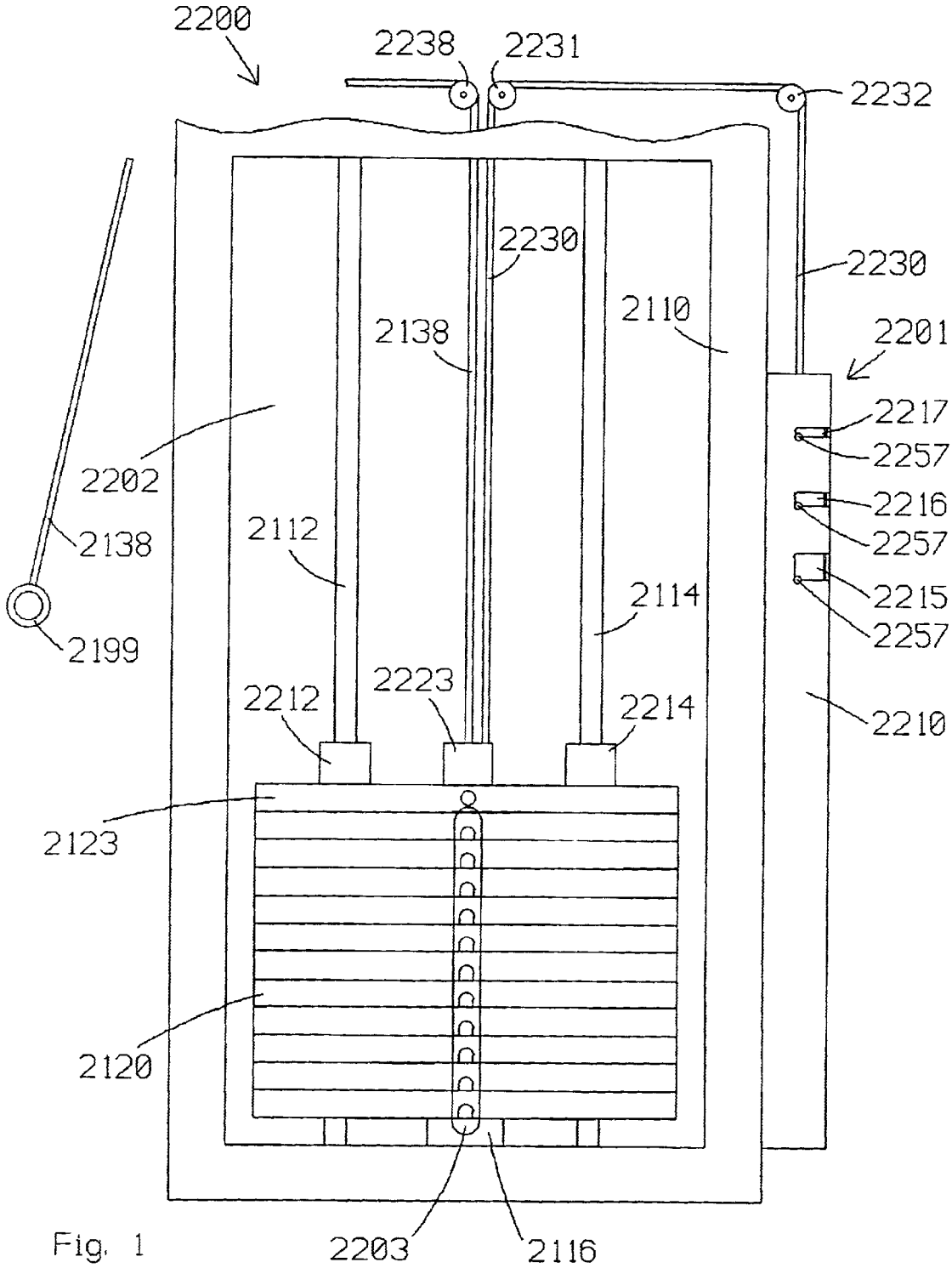
FIG. 1 is a partially fragmented, front view of an exercise apparatus constructed according to the principles of the present invention.

With reference to the Figures of the Drawing, wherein like numerals represent like parts and assemblies throughout the several views, FIG. 1 shows a weight stack machine 2200 that has been constructed in accordance with the principles of the present invention. The machine 2200 includes a top plate 2123 and additional, underlying weight plates 2120 which are arranged in a vertical stack and movably mounted on a frame 2110 by guide rods 2112 and 2114 (or other suitable means known in the art). Bushings 2212 and 2214 may be rigidly mounted on the top plate 2123 to encourage proper alignment of the top plate 2123 and the underlying weight plates 2120 relative to the guide rods 2112 and 2114. A resilient bumper 2116 is preferably mounted on a lower portion of the frame 2110 to support any weight plates not in use and/or to absorb impact when the lifted weight plates are returned to a rest position. A selector rod extends through the weight stack and is connected to at least one force receiving member 2199 by a cable 2138 (or other suitable means known in the art). An intermediate portion of the cable 2138 is routed about at least one pulley 2238 on the frame 2110.

A transparent shield 2202 is mounted on the frame 2110 and spans the front of the machine 2200, effectively separating a user of the machine 2200 from the guide rods 2112 and 2114 and the weight stack. A central slot 2203 is provided in the shield 2202 to facilitate insertion of a conventional selector pin into engagement with any desired weight plate 2120 in the stack. This embodiment 2200 requires a selector pin which inserts entirely inside the shield 2202, since the slot 2203 is limited to the height of the weight stack. However, those skilled in the art will recognize that other weight stack selection methods may be employed without departing from the scope of the present invention.

A central block 2223 is rigidly mounted on the top plate 2123 and axially aligned with the cable 2138. Both the weight stack cable 2138 and a second cable 2230 are connected to the block 2223 and/or the underlying top plate 2123. The second cable 2230 is routed about pulleys 2231 and 2232 to a secondary weight assembly 2201. A remote end of the cable 2230 is connected to a counterweight 2240 which preferably has a mass equal to that of the central block 2223 on the top plate 2123. As a result of this arrangement, the counterweight 2240 offsets the weight of the central block 2223 and maintains the cable 2230 taut as the top plate 2123 moves up and down relative to the frame 2110.

The assembly 2201 includes an elongate housing or tube 2210 that has a longitudinal axis and is mounted on a side of the frame 2110 by bolts or other suitable fasteners. One side of the housing 2210 is bounded by square corners and bears against the frame 2110. An opposite side of the housing 2210 is rounded and faces away from the frame 2110. Those skilled in the art will recognize that the present invention is not limited to such an arrangement. In any event, a vertical slot 2218 extends vertically along the rounded side of the housing 2210, to accommodate vertical travel of the weights 2250, 2260, and 2270 relative to the housing 2210. Discrete horizontal slots 2215, 2216, and 2217 extend from the vertical slot 2218 toward the front of the machine 2200, to accommodate rotation of respective weights 2250, 2260, and 2270 relative to the housing 2210. Each horizontal slot 2215, 2216, and 2217 terminates with a downwardly extending notch (designated as 2219 in FIG. 7), to bias a respective weight 2250, 2260, or 2270 to remain in place relative to the housing 2210.

As shown in FIG. 5, the cross-section of the housing 2210 is configured to accommodate the counterweight 2240 and the similarly sized secondary weights 2250, 2260, and 2270. The housing 2210 is preferable made of plastic, and the weights disposed inside the housing 2210 are preferably made of stainless steel, so that the latter are slideable relative to the former with relatively little frictional resistance. Other weight guiding arrangements, including strips of low friction material or guide rods, for example, may be used without departing from the scope of the present invention. Each of the weights 2250, 2260, and 2270 is preferably configured to weigh one-quarter as much as one of the weight plates 2120 in the stack. However, other quantities of mass and/or numbers of weights may be provided in the alternative.

FIG. 2 shows a cross-section of the lowest secondary weight 2250, which is representative of the other secondary weights 2260 and 2270 (and may also be representative of the counterweight 2240, depending upon manufacturing preferences). The weight 2250 may be described as a cylindrical shell having an outside diameter sized for linear movement within the housing 2210. A central bore 2253 extends through the weight 2250 and defines an inside diameter sized to accommodate unhindered passage of the cable 2230. A relatively larger diameter recess 2254 extends into the bottom of the weight 2250 to receive a rubber disk 2255, which defines an inside diameter at least as large as that of the bore 2253. If economies of scale dictate that the counterweight 2240 be configured similar to the secondary weight 2250, then an anchor piece may be configured to fasten to the end of the cable 2230 and to occupy the recess 2254 and bore 2253 on the counterweight 2240.

A shaft 2257 extends radially outward from each of the secondary weights 2250, 2260, and 2270. As suggested by FIGS. 3–5, handles 2258 (or other suitable members) may be mounted on the shafts 2257 to facilitate maneuvering of the weights 2250, 2260, and 2270 relative to the housing 2210. Each shaft 2257 is sized and configured to rest within a respective notch 2219, move along a respective horizontal slot 2215, 2216, or 2217, and move along the common vertical slot 2218. FIGS. 3–4 show each of the secondary weights 2250, 2260, and 2270 with its shaft 2257 occupying a respective notch 2219. Under these conditions, the secondary weights 2250, 2260, and 2270 are supported by the housing 2210 (in stationary positions), and the secondary weight assembly 2201 has no effect on the "primary" weight selected by a user of the machine 2200 (recognizing that the counterweight 2240 and the block 2223 simply counterbalance one another).

Figure 6:
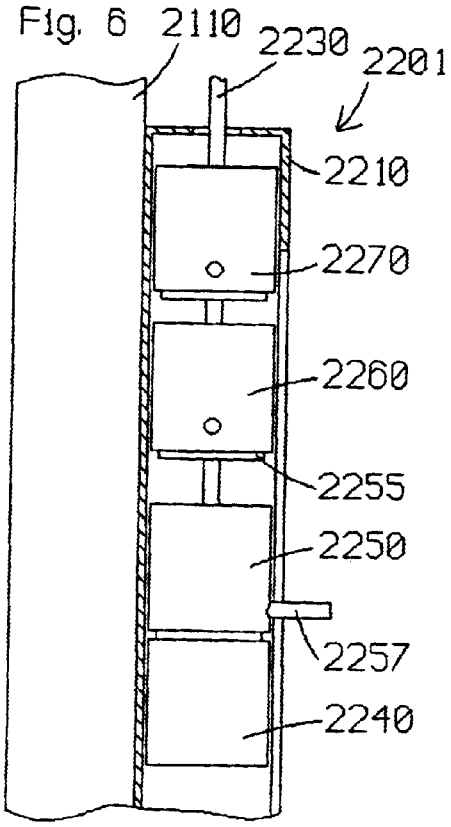
FIG. 6 is a partially sectioned fragmented, front view of the secondary weight assembly of FIG. 3, with one of the secondary weights rotated out of engagement with the secondary weight holder (and without the optional knobs)
Figure 7:
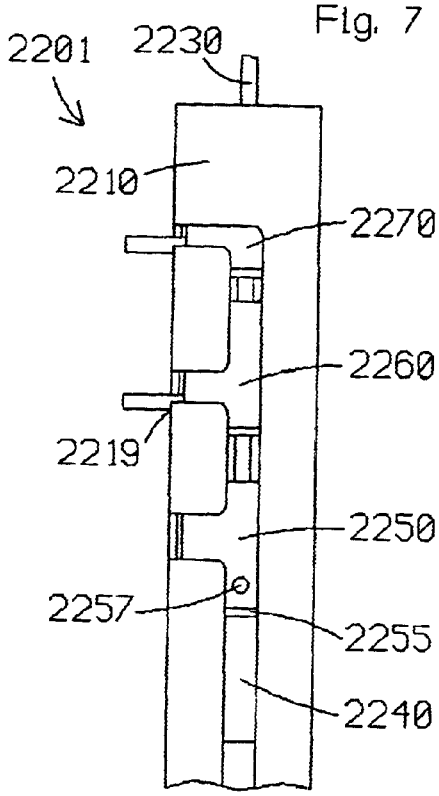
FIG. 7 is a partially fragmented, side view of the secondary weight assembly of FIG. 6.

FIGS. 6–7 show the lowest secondary weight 2250 with its shaft 2257 rotated out of its horizontal slot 2215 and into the vertical slot 2218. As a result, the lowest secondary weight 2250 is free of the housing 2210 and supported instead by the counterweight 2240. In this activated state, the secondary weight assembly 2201 reduces the exercise load of the primary weight stack by one-quarter of the weight of a plate 2120 in the primary weight stack. For example, if each of the weight plates 2120 weighs ten pounds, and one hundred pounds is currently secured to the selector rod, then the "activation" of the lowest secondary weight 2250 reduces the selected weight to ninety-seven and one-half pounds.

Figure 8:
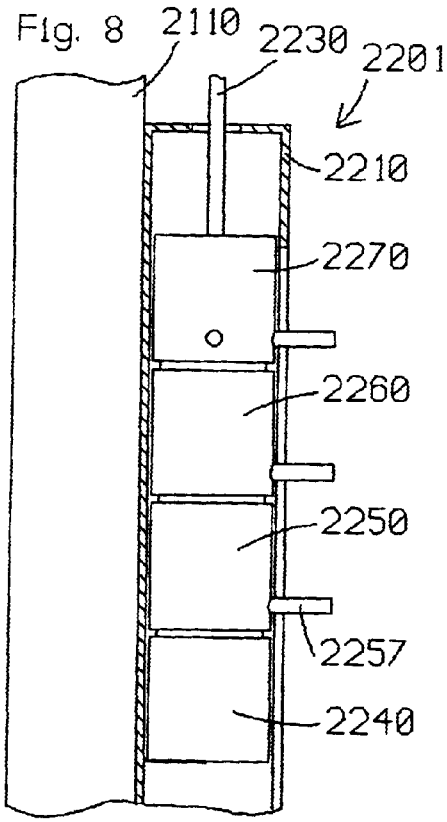
FIG. 8 is a partially sectioned fragmented, front view of the secondary weight assembly of FIG. 6, with all of the secondary weights rotated out of engagement with the secondary weight holder.
Figure 9:
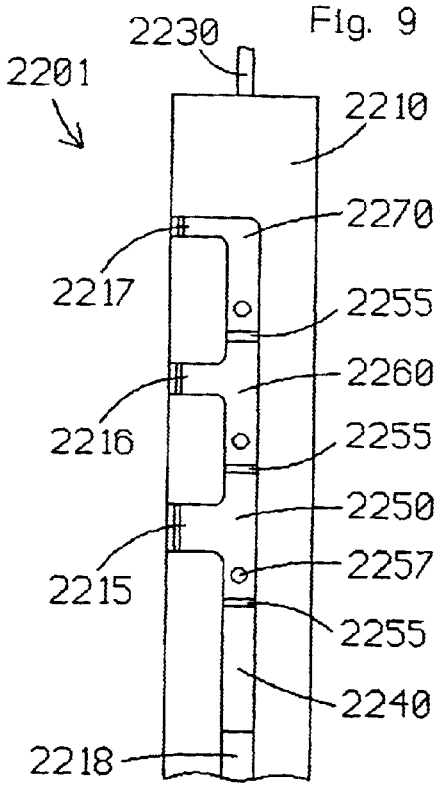
FIG. 9 is a partially fragmented, side view of the secondary weight assembly of FIG. 8.
Figure 10:
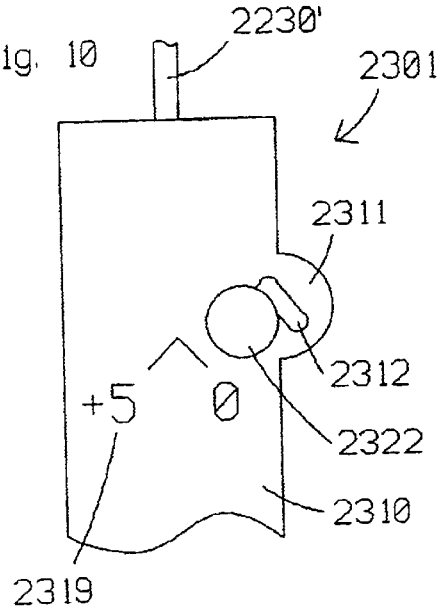
FIG. 10 is a front view of another secondary weight assembly constructed according to the principles of the present invention.
Figure 11:
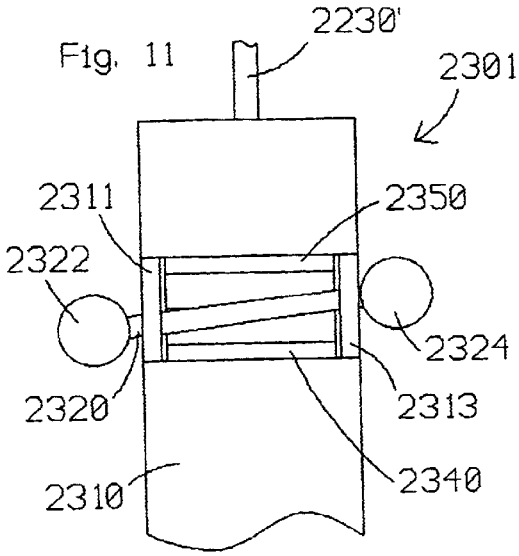
FIG. 11 is a side view of the secondary weight assembly of FIG. 10.

FIGS. 8–9 show all three secondary weights 2250, 2260, and 2270 with their shafts 2257 rotated out of their respective horizontal slots 2215, 2216, and 2217, and into the vertical slot 2218. As a result of this change, all three secondary weights 2250, 2260, and 2270 are free of the housing 2210 and supported by the counterweight 2240. In this activated state, the secondary weight assembly 2201 reduces the exercise load of the primary weight stack by three-quarters of the weight of a plate 2120 (or seven and one-half pounds in the example set forth in the foregoing paragraph).

The slots 2215, 2216, and 2217 are configured in such a manner that all three secondary weights 2250, 2260, and 2270 may be rotated together relative to the housing 2210. In this regard, the middle horizontal slot 2216 is sufficiently tall to accommodate travel of the middle weight 2260 upward into contact with the highest weight 2270 while the weights 2260 and 2270 are in their stationary orientation. Similarly, the lowest horizontal slot 2215 is sufficiently tall to accommodate travel of the lowest weight 2250 upward into contact with the middle weight 2260 while the weights 2250 and 2260 are in their storage orientation (regardless of the vertical position of the middle weight 2260 relative to the highest weight 2270). In other words, a user may lift up the lowest weight 2250 until both of the weights 2260 and 2270 are supported on the lowest weight 2250, and then the weights 2260 and 2270 will rotate together with the weight 2250 into activation (with the shafts 2257 within the vertical slot 2218).

In addition to reducing noise and/or absorbing impact, the rubber disks 2255 provide a high friction interface between adjacent weights to discourage relative rotation therebetween. Those skilled in the art will recognize that registration pegs or other suitable means may be provided in the alternative, or in addition to the disks 2255, to maintain the activated secondary weights in alignment with both the counterweight 2240 and one another.

Those skilled in the art will also recognize that the secondary weight assembly 2201 may be operated in an additive mode, as opposed to a deductive mode, from the perspective of a person using the machine 2200. For example, from the user's perspective, the secondary weights 2250, 2260, and 2270 could be considered "zeroed" when activated and movable along the vertical slot 2218, and "additive" when deactivated and supported by the housing 2210. In this alternative arrangement, the top plate 2123 is preferably configured to provide ten pounds of resistance when all four of the weights 2240, 2250, 2260, and 2270 are supported on the cable 2230. When the shaft 2257 on the highest weight 2270 is rotated into the horizontal slot 2217 (a stationary position), the result is a two and one-half pound increase in the user-applied force required to lift the top plate 2123.

Another embodiment of the present invention is designated as 2301 in FIGS. 10–14. Like the previous embodiment 2201, the secondary weight assembly 2301 is suitable for use in connection with a primary weight stack. The assembly 2301 similarly includes a tubular housing or sleeve 2310 that is sized and configured to accommodate passage of a "counter-weighting" cable 2230', as well as vertical travel of both an anchor weight 2340 and a secondary weight 2350. Among other things, the assembly 2301 allows a person to latch and unlatch the secondary weight 2350 without lifting or otherwise handling the secondary weight 2350.

One end of the cable 2230' is preferably connected to the top plate in a weight stack, and an opposite end of the cable 2230' is secured relative to the anchor weight 2340. For example, the cable 2230' may be inserted through a central opening in the anchor weight 2340 and secured to ball 2334 having a diameter greater than the opening. A recess is preferably provided in the bottom of the anchor weight 2340 to accommodate the upper half of the ball 2340. The cable 2230' is routed through an opening in the secondary weight 2350 having an inside diameter that is significantly greater than the diameter of the cable 2230'. To the extent that economies of scale may warrant making the weights 2340 and 2350 similar in size and shape, an insert may be provided for the opening in the anchor weight 2340 to secure the cable 2230' relative thereto.

Forward and rearward flanges 2311 and 2313 are provided on the right side of the housing 2310. The forward flange 2311 is provided with an opening 2312 that may be described in terms of an inverted V having a first leg that extends in front of the secondary weight 2350, and a second leg that extends away from the secondary weight 2350 and beyond the side wall of the housing 2310. The rearward flange 2313 is provided with a circular opening 2314 that is aligned with the vertex of the V-shaped opening 2312.

A selector pin 2320 extends through both openings 2312 and 2314. The selector pin 2320 has a forward end connected to a knob 2322, and a rearward end connected to another knob 2324, or any other member suitable for creating a ball joint or a sloppy pivot joint. In this regard, the diameter of the opening 2314 is greater than the diameter of the pin 2320, and the length of the pin 2320 is greater than the depth of the housing 2310, thereby allowing the pin 2320 to pivot in non-parallel planes.

In the absence of exercise activity, the force of gravity acting upon the top plate in the primary weight stack exerts an upward force on the portion of the cable 2230' extending within the housing 2310. This upward force is sufficient to support both the anchor weight 2340 resting on the ball 2334, and the secondary weight 2350 resting on the anchor weight 2340. An interface is defined in the area of contact between the secondary weight 2350 and the anchor weight 2340, and the assembly 2301 is constructed so that this interface is laterally aligned with the flanges 2311 and 2313 when the cable 2230' is at rest. A notch 2352 is provided in the lower right side of the secondary weight 2350, and a similar notch 2342 is provided in the upper right side of the anchor weight 2340. Either notch 2352 or 2342 is sufficient to define a gap between the weights 2350 and 2340, and thereby provide clearance for operation of the selector pin 2320.

Figure 13:
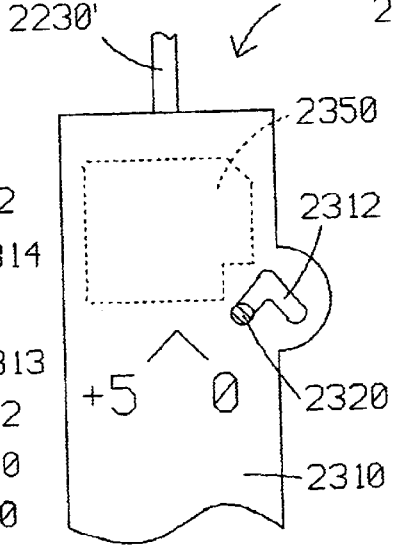
FIG. 13 is a partially sectioned front view of the secondary weight assembly of FIG. 10 (showing the assembly with its selector pin moved to an active position)

When the selector pin 2320 occupies the position shown in FIG. 13, the pin 2320 blocks the path of the secondary weight 2350. As a result, the anchor weight 2340 will move down and up by itself during exercise activity. Depending on tolerances, the secondary weight 2350 may move a small amount, with the effect of reducing the overall resistance at the very beginning of the exercise stroke (which some people may consider a beneficial feature). The force of gravity acting on the secondary weight 2350 and the pin 2320 biases the pin 2320 to remain in the position shown in FIG. 13. Additional biasing arrangements, including a toggled or over-center spring, may also used to maintain the pin 2320 in a desired position.

Figure 14:
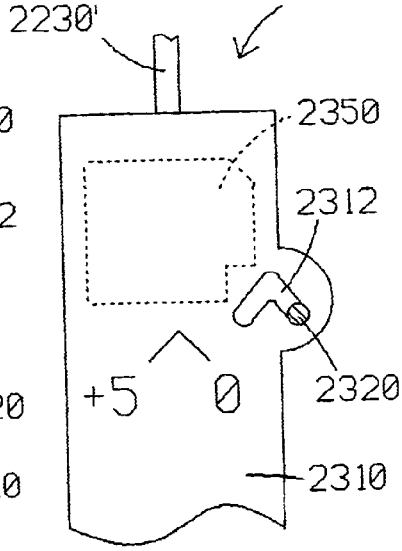
FIG. 14 is a partially sectioned front view of the secondary weight assembly of FIG. 10 (showing the assembly with its selector pin moved to an inactive position)

When the selector pin 2320 is moved to the position shown in FIG. 14, the pin 2320 is outside the path of the secondary weight 2350, and the secondary weight 2350 is free to move down and up together with the anchor weight 2340 during exercise activity. The force of gravity acting on the pin 2320 biases the pin to remain in the position shown in FIG. 14. Indicia 2319 may be provided on the housing 2310 to indicate the effect of moving the pin 2320 between opposite ends of the V-shaped opening 2312. On this embodiment 2301, the secondary weight 2350 is designed to change the resistance by 5 pounds, an amount equal to one-half the weight of each plate in the primary weight stack.

Figure 12:
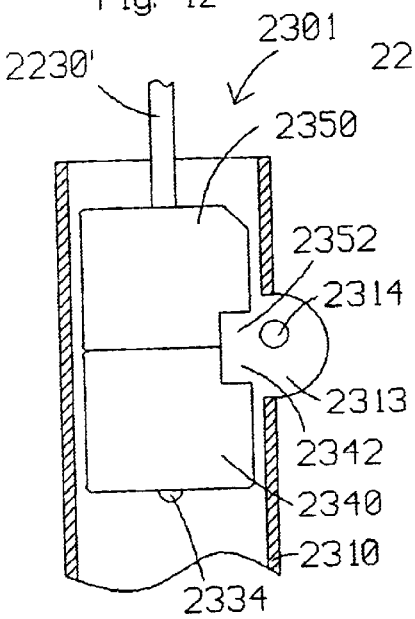
FIG. 12 is a partially sectioned front view of the secondary weight assembly of FIG. 10 (showing the assembly with its selector pin removed)

In the event that the pin 2320 is accidentally moved to the position shown in FIG. 13 while the secondary weight 2350 is beneath its rest position, upward motion of the secondary weight 2350 will simply urge the pin 2320 upward, until the pin 2320 is no longer in the way. As shown in FIGS. 12–14, the upper right side of the secondary weight 2350 may be beveled to help perform this function. Generally speaking, it may be desirable to bevel or chamfer all of the corners and edges of the weights 2350 and 2340 to facilitate smooth travel thereof.

Yet another embodiment of the present invention is designated as 2401 in FIGS. 15–18. Like the previous embodiment 2301, this secondary weight assembly 2401 is also suitable for use in connection with a primary weight stack, and it also enables a person to latch and unlatch a secondary weight 2450 without lifting or otherwise handling the secondary weight 2450. The assembly 2401 similarly includes a tubular housing or sleeve 2410 that is sized and configured to accommodate passage of a connector cable 2230", as well as vertical travel of both the secondary weight 2450 and an anchor weight 2440. The cable 2230" is preferably arranged in the same manner as the cable 2230', extending downward into the housing 2410 and through an opening 2453 in the secondary weight 2450, and connected to the anchor weight 2440 by means of a ball 2434.

In the absence of exercise activity, the cable 2230" and the weights 2440 and 2450 occupy the respective positions shown in FIG. 15. Each of the weights 2440 and 2450 has a relatively larger cross-section that is octagonal, and a relative smaller cross-section that is square. The weights 2440 and 2450 are arranged so that the square portion 2454 of the secondary weight 2450 rests on the square portion 2444 of the anchor weight 2440, thereby defining a gap between the octagonal portion of the secondary weight 2450 and the octagonal portion of the anchor weight 2440.

The housing 2410 has opposing side walls with respective slots 2412 that are laterally aligned with the interface between the two inactive weights 2440 and 2450. The slots 2412 extend perpendicular to the cable 2230" on the embodiment 2401, but they may be configured in alternative ways to achieve various results. At a location beneath the slots 2412, an L-shaped support 2414 extends outward from the front wall of the housing 2410 and then upward. A selector pin 2420 has opposite end portions 2422 that extend toward one another and into respective slots 2412. The pin 2420 is generally U-shaped and sufficiently large to just straddle the housing 2410. An intermediate portion 2424 of the pin 2420 serves as both a handle for purposes of moving the pin 2420, and a stop for purposes of limiting movement of the pin 2420.

FIG. 16 shows the pin 2420 in an inactive position, with the ends 2422 of the pin 2420 in the forward ends of respective slots 2412, and outside the planform of the secondary weight 2450 (and outside the planform of the anchor weight 2440). The pin 2420 is hanging downward from the slots 2412, and the intermediate portion 2424 of the pin 2420 extends beneath the support 2414 and is resting against the front wall of the housing 2410. The force of gravity acting on the pin 2420 biases the pin 2420 to remain in this position. When the pin 2420 occupies the position shown in FIG. 16, the secondary weight 2450 is free to move down and up together with the anchor weight 2440 during exercise activity.

FIG. 17 shows the pin in an intermediate position, with the handle portion 2424 of the pin 2420 pivoted upward into co-planar alignment with the slots 2412, and outside the planform of the support 2414. FIG. 18 shows the pin 2420 in an active position, with the ends 2422 of the pin 2420 in the rearward ends of respective slots 2412, and beneath the octagonal portion of the secondary weight 2450. The pin 2420 is hanging downward (to a lesser extent than in FIG. 16), and is resting on the support 2414 and inside the upwardly extending end of the support 2414. The support 2414 cooperates with the force of gravity acting on the pin 2420 to maintain the pin 2420 in this position. When the pin 2420 occupies the position shown in FIG. 18, the anchor weight 2440 moves down and up by itself during exercise activity.

The present invention may be considered advantageous to the extent that it facilitates storage and/or handling of the weights outside the path of the primary weight stack; accommodates any desired shrouding of the machine components; does not negatively impact the balance of the top plate; does not require handling of the secondary weight; and/or does not require elaborate guides for the secondary weight (which moves in a direction opposite the primary weight stack). Among other things, the opposite, downward movement of the secondary weight renders the present invention relatively safer and easier to use. For example, any accidental release of the secondary weight causes a decrease in exercise resistance. Moreover, the present invention requires little, if any, handling of the secondary weight.

Those skilled in the art will also recognize that the present invention may be implemented in a variety of ways. For example, the subject invention is not limited to the operational specifics of the depicted weight selection assemblies, and other weight selection methods, including ones disclosed in U.S. Pat. No. 5,944,642 and the patents identified above in the Background of the Invention (all of which are incorporated herein by reference), may be used to selectively engage and disengage counterweight (s) vis-a-vis the cable 2230 or other connector. Also, the present invention may be implemented with a flexible connector, such as cable 2230, or with other connector arrangements, including a pivoting lever, for example. Moreover, features and/or applications discussed with reference to particular embodiments may be mixed and matched to arrive at additional embodiments and/or methods. In other words, the foregoing description not only references specific embodiments and particular methods, but it also provides sufficient information to enable those skilled in the art to recognize additional embodiments, methods, improvements, combinations, and/or applications. In view of the foregoing, the scope of the present invention is to be limited only to the extent of the following claims.

What is claimed is:

1. An exercise apparatus, comprising:

a frame;

a stack of weights that is movably mounted on the frame, wherein the stack includes a top plate that is movable along a prescribed path;

a flexible cable having a first portion, a second portion, and a third, intermediate portion, wherein the first portion is connected to the top plate, and the intermediate portion is connected to the frame in a manner that constrains the second portion and the first portion to always move in opposite directions;

a separate weight that is disposed outside the path of the top plate and proximate the second portion of the cable; and a selector that is movable relative to the frame between a first operative position, underlying the separate weight and thereby preventing downward movement of the separate weight, and a second operative position, outside a planform defined by the separate weight and thereby leaving the separate weight supported by the second portion of the cable for downward movement together with the second portion of the cable in response to upward movement of the top plate, and for subsequent upward movement together with the second portion of the cable in response to downward movement of the top plate.

2. The exercise apparatus of claim 1, wherein the intermediate portion of the cable is routed about at least one pulley on the frame.

3. The exercise apparatus of claim 1, wherein the cable extends through the separate weights.

4. The exercise apparatus of claim 1, wherein the selector is movably mounted on the frame for movement between the first position and the second position.

5. The exercise apparatus of claim 1, further comprising an anchor weight connected to the second portion of the connector beneath the separate weight.

6. The exercise apparatus of claim 1, further comprising a lower weight constrained to remain beneath the separate weight and supported by the second portion of the cable, wherein availability of the lower weight for movement together with the second portion of the cable is independent of the position of the selector.

7. The exercise apparatus of claim 1, further comprising a force receiving member; and a discrete flexible cable having a first portion connected to the force receiving member, a second portion connected to the top plate, and a third, intermediate portion routed about at least one pulley on the frame.

8. The exercise apparatus of claim 1, wherein the selector is constrained to remain at a fixed elevation on the frame.

9. The exercise apparatus of claim 1, further comprising a guide on the frame that is disposed about the separate weight to limit movement of the separate weight to a prescribed path.

10. A method of adjusting resistance to exercise, comprising the steps of:

providing a frame;

providing a stack of weights which includes a top plate;

movably mounting the stack on the frame in such a manner that the top plate is movable along a prescribed path;

providing a counter-weight outside the path of the top plate;

providing a flexible cable having a first portion, a second portion, and a third, intermediate portion;

connecting the first portion of the cable to the top plate;

connecting the intermediate portion of the cable to the frame in a manner that constrains the first portion and the second portion to always move in opposite directions; and selectively switching between a first mode of operation, wherein the counter-weight is anchored to the frame at an elevated storage position, and a second mode of operation, wherein the counter-weight is connected to the second portion at the cable for movement downward from the storage position to decrease resistance to upward movement of the top plate, and for subsequent movement upward toward the storage position to increase resistance to downward movement of the top plate.

11. The method of claim 10, wherein the switching step involves moving a selector from an active position, underlying the counter-weight, to an inactive position, outside a planform defined by the counter-weight.

12. The method of claim 10, further comprising the step of movably mounting the counter-weight relative to the frame for movement along a prescribed path when moving together with the second portion of the cable.

13. The method of claim 10, further comprising the steps of providing a second said counter-weight above the first counter-weight; and maintaining the second said counter-weight in a relatively higher inactive position during each said mode of operation.

14. The method of claim 13, further comprising the step of selectively switching to a third mode of operation, wherein each said counter-weight is connected to the second portion of the cable to further decrease resistance to upward movement of the top plate by moving downward during upward movement of the top plate.

15. The method of claim 13, further comprising the step of routing the second portion of the cable through the second said counter-weight.

16. The method of claim 10, further comprising the step of routing the second portion of the cable through the counter-weight.

17. The method of claim 16 further comprising the step of connecting an anchor weight to the second portion of the cable at a location beneath the counter-weight.

18. The method of claim 10, further comprising the steps of providing a force receiving member and a second flexible cable; and connecting a first portion of the second cable to the top plate, connecting a second portion of the second cable to the force receiving member, and connecting a third, intermediate portion of the cable to the frame.

19. An exercise apparatus, comprising:

a frame;

a stack of weights, including a top plate, movably mounted on the frame for movement along a prescribed path;

a counter-weight disposed outside the path;

a flexible cable having a first portion, a second portion, and a third, intermediate portion, wherein the first portion is connected to the top plate, and the intermediate portion is connected to the frame in a manner that constrains the second portion and the first portion to always move in opposite directions; and a connecting means for selectively connecting the counter-weight to the frame at an elevated storage position, and for alternatively releasing the counter-weight onto the second portion of the cable for movement together with the second portion of the cable to decrease resistance to upward movement of the top plate, and to increase resistance to downward movement of the top plate.

20. The exercise apparatus of claim 19, further comprising a force receiving member; and a separate flexible cable having a first portion connected to the top plate, and a second portion connected to the force receiving member.

21. The exercise apparatus of claim 19, wherein the second portion of the cable is routed through the counter-weight.

22. The exercise apparatus of claim 21, wherein an anchor weight is disposed beneath the counter-weight and is connected to the second portion of the cable.

23. The exercise apparatus of claim 19, further comprising a second said counter-weight, wherein the connecting means is operable to maintain the second said counter-weight in a relatively higher storage position above the first counter-weight, while allowing the first counter-weight to move together with the second portion of the cable in response to movement of the top plate.

24. The exercise apparatus of claim 23, wherein the connecting means is alternatively operable to release each said counter-weight onto the second portion of the cable for movement together with the second portion of the cable to further decrease resistance to upward movement of the top plate, and to further increase resistance to downward movement of the top plate.

* * * * *